US006926517B2

(12) United States Patent
Van Vleet

(10) Patent No.: US 6,926,517 B2
(45) Date of Patent: Aug. 9, 2005

(54) APPARATUS AND METHOD FOR SIMULATED CAMPFIRE

(76) Inventor: Daniel W. Van Vleet, 525 1st St., Gurley, NE (US) 69141

( * ) Notice: Subject to any disclaimer, the term of this patent is extended or adjusted under 35 U.S.C. 154(b) by 47 days.

(21) Appl. No.: 10/695,359

(22) Filed: Oct. 28, 2003

(65) Prior Publication Data

US 2005/0089812 A1 Apr. 28, 2005

(51) Int. Cl.[7] ..... F23Q 2/32; F24B 1/181
(52) U.S. Cl. ..... 431/125; 126/512; 126/519
(58) Field of Search ..... 126/519, 512, 126/500, 503, 38, 9 R, 92 R, 91, 92 AC, 126/41 R; 431/125; D23/348, 332

(56) References Cited

U.S. PATENT DOCUMENTS

| | | | | |
|---|---|---|---|---|
| 0,254,709 | A | 3/1882 | Sheldon | |
| 1,713,659 | A | 5/1929 | Karr | |
| 2,113,012 | A | 4/1938 | Albrecht et al. | |
| 2,154,305 | A | 4/1939 | Goerl | |
| 2,482,797 | A | 9/1949 | Quinnell et al. | |
| 3,038,064 | A * | 6/1962 | Gieb | 431/125 |
| 3,362,395 | A | 1/1968 | Peterson | |
| 3,385,651 | A | 5/1968 | Rasmussen et al. | |
| 3,409,000 | A | 11/1968 | Brader et al. | |
| 3,529,557 | A | 9/1970 | Treanor | |
| 3,593,647 | A | 7/1971 | Copeland | |
| 3,630,189 | A | 12/1971 | Hodges et al. | |
| 3,641,922 | A | 2/1972 | Stanley et al. | |
| 3,671,175 | A * | 6/1972 | Campbell | 431/328 |
| 4,531,506 | A | 7/1985 | Chambers et al. | |
| 4,651,708 | A | 3/1987 | Groeneweg | |
| 4,890,601 | A | 1/1990 | Potter | |
| 4,903,683 | A | 2/1990 | Larsen et al. | |
| 5,094,223 | A | 3/1992 | Gonzalez | |
| 5,359,988 | A | 11/1994 | Hait | |
| 5,404,864 | A | 4/1995 | Kent, Jr. | |
| 5,413,087 | A | 5/1995 | Jean | |
| 5,421,321 | A | 6/1995 | Ward | |
| 5,868,128 | A | 2/1999 | Omar | |
| 5,901,697 | A | 5/1999 | Oliver, Jr. et al. | |
| 6,044,836 | A | 4/2000 | Oliver, Jr. et al. | |
| 6,227,843 | B1 | 5/2001 | Pedersen et al. | |
| 6,488,025 | B1 * | 12/2002 | Cunningham | 126/92 AC |
| 2003/0164167 | A1 | 9/2003 | Van Vleet | |

FOREIGN PATENT DOCUMENTS

| | | | |
|---|---|---|---|
| GB | 2228791 | A | 9/1990 |

* cited by examiner

*Primary Examiner*—James C. Young
(74) *Attorney, Agent, or Firm*—Timothy J. Martin; Michael R. Henson; Rebecca A. Gegick

(57) ABSTRACT

Apparatus for simulating a campfire includes a fire pan, a diffuser element in the pan interior and a gas injector extending into the interior. The gas injector has an outlet that introduces vaporized fuel so that the diffuser element disperses the vaporized fuel about the pan interior. Non-flammable particulate material may be provided at a depth sufficient to cover the outlet. A lid may be secured to the pan, for example, by the diffuser element. The fire pan may have a lower chamber portion and an upper pan portion with the outlet terminating in the lower chamber portion. The diffuser element may be centrally located in the pan. The method provides such a fire pan and directs the flow of gas toward the diffuser so that the gas is diffused upwardly to be ignited on the surface of the particulate material.

33 Claims, 6 Drawing Sheets

APPARATUS AND METHOD FOR SIMULATED CAMPFIRE

FIELD OF THE INVENTION

The present invention broadly concerns camping and outdoor equipment. More particularly, the present invention is directed to portable campfires that generally can be used in any outdoor environment. Specifically, the present invention is directed to a portable campfire apparatus and method that provides aesthetic pleasure while reducing risks to people and their environment. The present invention especially concerns a portable gas simulated campfire apparatus and method.

BACKGROUND OF THE INVENTION

In pre-historic times, humans depended on fire for survival. Fire provided light, warmth, protection from animals, and a means for cooking food. As a consequence of this reliance, humans also formed an intimate psychological connection with fire. Mysticism imparted certain spiritual and religious attributes to fire, gradually transforming the hearth into a place for social gathering. People congregated around open fires to interact with each other, dance, pray, and teach the new generation the history of the old. Arguably, these congregations helped to unify people and initiate the development of societies.

As time progressed, fire maintained a significant presence in the daily lives of people. Most homes were constructed with large fireplaces to serve as a source of light and heat, as well as a place to cook food. Humans discovered new and improved uses for fire. For example, gas lamps allowed fire to be portable and light areas without the need of an open fire. Fire also became used for tool making, weapons, and other articles of manufacture. In modern times, fire is still used as a source of light, heat, and means for cooking food. However, in general, its importance is diminished as compared to the past. Electricity has generally negated the need for fire as a source of light and open fires in fireplaces are typically not used as the primary source for heat or cooking. Generally, the modern home is furnished with electric or fuel heat, stoves, ovens, microwaves, and a variety of light fixtures.

For many people, the psychological bond with fire has endured all of these technological substitutes because they are generally enchanted by fire's esthetic qualities, its glow, its warmth, and even its smell. As a result, many homes continue to be constructed with fireplaces. Some homes have wood burning fireplaces while others are equipped with gas logs controlled by a remote on/off switch. In addition, many homes and dining tables are decorated with a variety of candles made of wax or decorative glass objects containing oils therein.

Fire is also present in the modern outdoor experience. Perhaps the most common of the modern outdoor experiences is cooking over an open flame on backyard barbecue grills. Oftentimes, backyard barbecues are associated with the gathering of friends and family for pleasurable occasions. Barbecue grills exist in a variety of forms including charcoal and gas grills. While some grills are permanently affixed to an area, others are designed to be transportable for grilling at tailgate parties, campgrounds, and the like. Those that enjoy cooking outdoors in more remote locations value lightweight, compact camping stoves that are easily stowed in backpacks. These camping stoves are typically gas fired so that the backpacker is not required to also carry wood or charcoals on the trip.

In addition to cooking outdoors, many people still enjoy gathering around open fires. At parties, some people build outdoor fires in their backyards or along beaches. Usually these outdoor fires serve as one of the party's main attractions, alluring people to its warmth and light just as it did in the past. For others, open fires are enjoyed in national parks or other wilderness areas around the world. These fires are built either in designated pits or near chosen campsites and are sometimes a setting for campers to roast marshmallows and tell stories. Unfortunately, it has become increasingly dangerous for people to enjoy open fires outdoors, especially in national parks and wilderness areas. Persistent dry weather during the summer months create land very susceptible to uncontrollable fires that endanger lives, homes and even ancestral treasures. Prohibitions on outdoor fires are becoming commonplace in many national parks and wilderness areas.

Accordingly, there remains a need to provide a new design and construction for an open fire that greatly reduces the risk of causing uncontrollable fires, while at the same time, provides other attributes of an open fire. There is a further need to provide a design and construction for an open fire that is portable for those who enjoy fire in national parks or other wilderness areas. The present invention is particularly directed to meeting these needs.

SUMMARY OF THE INVENTION

It is an object of the present invention to provide a new and useful campfire apparatus and method that is adapted to provide an open flame.

It is another object of the present invention to provide a camp stove and method adapted to create an open fire that is relatively free of embers.

A further object of the present invention is to provide a gas-fired camp stove that is portable yet provides an open flame in a relatively safe and convenient manner.

Yet another object of the present invention is to provide a camp stove that is gas powered to provide the appearance of open flames.

Yet another object of the present invention is to provide a camp stove that is easily manufactured and inexpensive in construction.

According to the present invention, then, a campfire apparatus is adapted to be placed in an assembled state on a support surface and connected to a source of fuel. Broadly, the campfire apparatus includes a base adapted to rest on the support surface when in an assembled state. A fire pan is adapted to be supported by the base when in the assembled state with the fire pan including a main body portion that has an inner surface, an upper rim and a pan interior. A gas injector is then adapted to be disposed in the pan interior when in the assembled state. This gas injector has at least one gas outlet operative to introduce vaporized fuel into the interior of the fire pan when connected to the source of fuel. The gas injector is adapted to introduce the vaporized fuel in the proximity of a diffuser element located in the interior of the fire pan and operative to disperse the vaporized fuel into the interior of the fire pan. A quantity of low density, non-flammable particulate material is adapted to be disposed in the fire pan at a depth sufficient to cover the gas injector and diffuser element when in the assembled state.

The particulate material should be sufficient so that the vaporized fuel migrates upwardly therethrough without igniting until it reaches the surface of the particulate material when connected to a source of fuel. To this end, campfire apparatus has a connector associated with the gas injector that is adapted to connect to the source of fuel. The source of fuel is in the form of a reservoir that is portable, such as a propane tank. In any event, the particulate material is selected from a group consisting of particles of materials such as silicates, carbonates, coarse sands and certain ores. A preferred particulate material is vermiculite.

A lid may also be provided with this lid being sized and adapted to enclose the pan interior when placed thereon in a mounted state. A portion of the lid is thus supported by a portion of the main body of the fire pan. To this end, the fire pan can include an inwardly projecting shoulder disposed in surrounding relation on the upper rim with this shoulder portion operative to support the lid when the lid is in a mounted state. The diffuser element may also be adapted to connect to the lid for securing the lid to the fire pan when the lid is in the mounted state.

Preferably, the base, the fire pan and the lid have generally the same geometrical configuration so as to reduce manufacturing costs. A spacer may also be provided with this spacer adapted to be interposed between the fire pan and the base when in the assembled state so that the base supports the spacer and the spacer supports the fire pan. The base and the fire pan may be configured as a geometric shell selected from a group consisting of: a portion of a spherical shell, a truncated pyramidal shell, a rectangular parallelepiped shell, a polyhedral shell, a conical shell, a cylindrical shell and a pyramidal shell. The lid may also have substantially the same geometric structure as the fire pan and the base. It is desired that the base and the fire pan be sized so that the plane of the upper rim is oriented parallel to the support surface when in an upright position but, when tipped over, the plane of the upper rim is oriented at no less than 900 to the support surface so that the plane of the rim is oblique to the support surface. When assembled, it is desired that the fire pan, the base and the spacer have central axes that are co-linear. In assembly, one or more bolts interconnect the fire pan and the base with the spacer interposed therebetween. Here, bolts may extend between the base and the fire pan through the hollow interior of the spacer. The bolts may also extend through the interior of the fire pan and provide a connection for securing the lid when it is in the mounted state.

The gas injector is adapted to extend from the outside of the fire pan into its interior and includes a connector on the exterior for attachment of to a fuel source. The gas injector extends inwardly into the interior of the fire pan and includes a gas outlet where the vaporized fuel exits into the interior of the fire pan. The gas outlet is located in close proximity of at least one diffuser element which is adapted to disperse the fuel vapor throughout the particulate material.

The present invention is also directed to a method of providing an artificial camp fire on a support surface. This method includes a first step of providing a fire pan having an interior and wherein the fire pan includes a gas diffuser disposed in the interior thereof. Next, the fire pan is supported in spaced relation to the support surface such that the interior thereof is upwardly opening. The method includes the step of placing a quantity of low density, fire retardant particulate material in the fire pan at a depth sufficient to cover the gas outlet thereby to achieve a surface spaced completely above the gas outlet. The method then includes the step of introducing a fuel into the interior of the fire pan at a velocity sufficient so that fuel flow is dispersed by the diffuser and diffused and diffused upwardly by the particulate matter. The method then includes the step of igniting the vaporized fuel along the surface of the particulate material. The method may also include any step that is accomplished by the structure of the campfire apparatus described above.

These and other objects of the present invention will become more readily appreciated and understood from a consideration of the following detailed description of the exemplary embodiments of the present invention when taken together with the accompanying drawings, in which:

DETAILED DESCRIPTION OF THE EXEMPLARY EMBODIMENTS

The present invention is directed to a portable campfire apparatus or camping stove that provides the aesthetic attributes of an open campfire that is relatively safe and convenient to use, even in situations where open fires may otherwise present a danger to humans or the environment. This campfire apparatus may connect to a source of fuel and provides a non-ember producing flame. Moreover, the construction design is such so that it can be produced at relatively reduced costs so that it may be quite affordable to the consumer.

Figure 1:
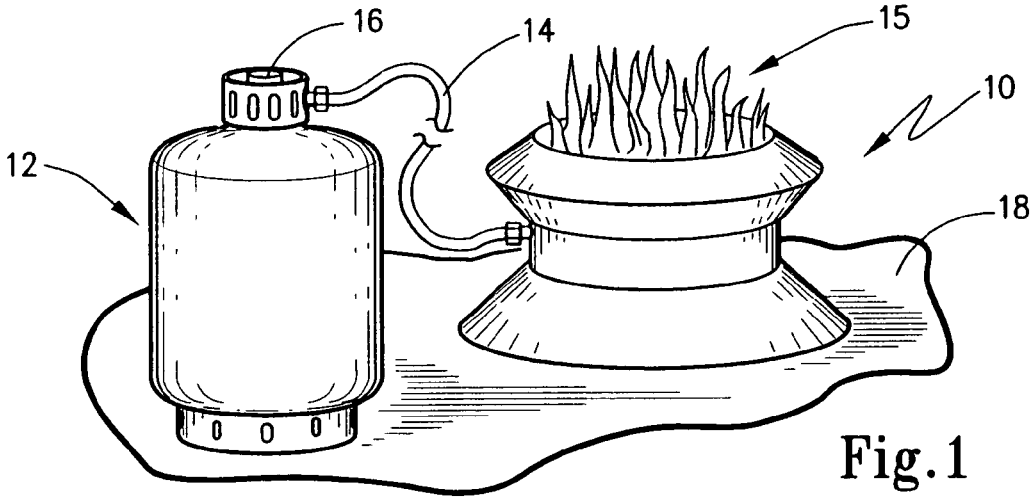
FIG. 1 is a perspective view showing the campfire apparatus of a first embodiment of the present invention attached to a portable fuel supply and in an operative condition.

With reference to FIG. 1, the campfire apparatus 10 is shown connected to a fuel canister 12 by means of a conduit 14. Campfire 10 as shown, in FIG. 1, in an operative apparatus wherein flames 15 are shown for representative purposes. Fuel canister 12 may be of any convenient type, but is preferably a propane canister having a valve 16 as is known in the art. Campfire apparatus 10, as well as fuel canister 12, is adapted to be placed in an upright position on a support surface 18 that may be any suitable surface, such as the ground, a patio, a deck or the like.

Figure 2:
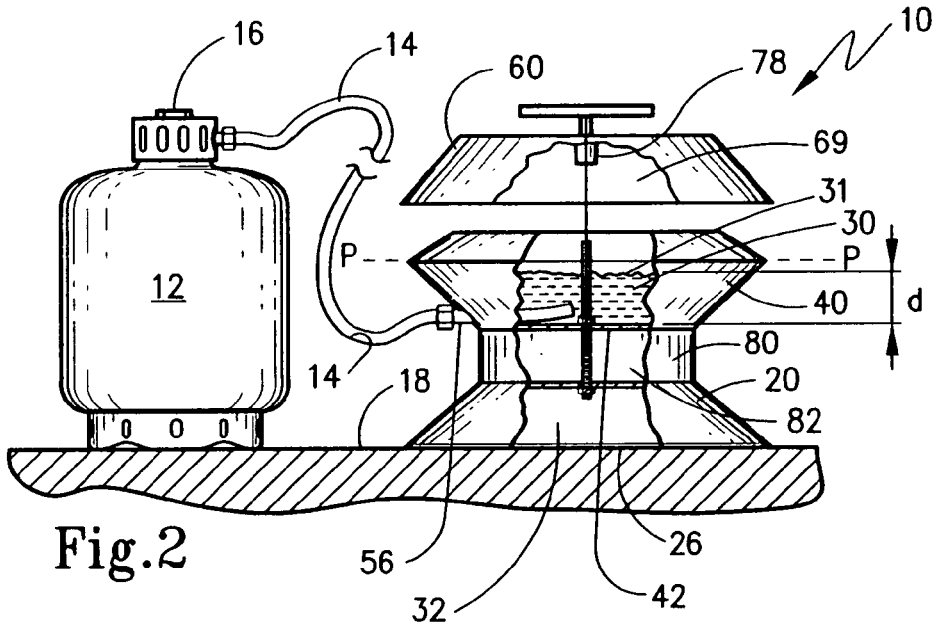
FIG. 2 is a side view in elevation of the campfire apparatus of FIG. 1 partially broken away and including the lid structure therefor.
Figure 3:
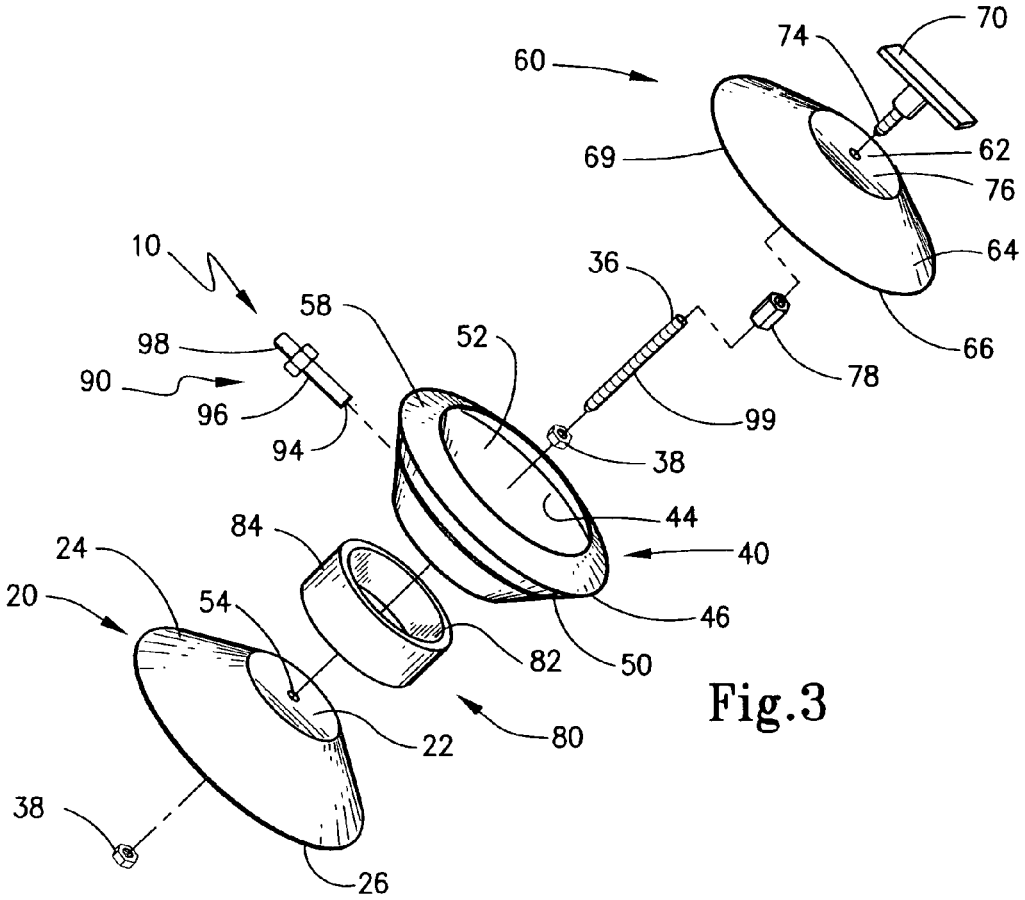
FIG. 3 is an exploded perspective view of the campfire apparatus of FIGS. 1 and 2.

A first embodiment of campfire apparatus 10 is shown in greater detail in FIGS. 2 and 3. In these Figures, it may be seen that campfire apparatus 10 includes a base 20, a fire pan 40, a lid 60 and a spacer 80. Base 20 is preferably in the form of an inverted frustum having a circular flat wall 22 and a side wall 24 that is formed of a conic section that extends from flat wall 22 to terminate in an edge 26 and to create an open interior 32. Edge 26 is adapted to rest on the support surface 18 when in the assembled state, as is shown in FIG. 2.

Fire pan 40 includes a main body portion 50 that is constructed substantially identically to base 20. Accordingly, fire pan 40 has a circular flat wall 42 and a side wall 44 formed as a conic section that terminates in an upper edge or rim 46. Flat wall 42 and side wall 44 thus form a frustum having an open interior 52 similar to open interior 32 of base 20.

When in the assembled state, this first embodiment has a spacer 80 that is interposed between side walls 24 and 44 of base 20 and fire pan 40, respectively. To this end, spacer 80 has a cylindrical sidewall 84 and an open interior 82. Base 20 and fire pan 40 are releasably secured together by means of diffuser element 99 in the form of a threaded rod and nuts 38. The diffuser 99 extends through holes 34 and 54 formed, respectively, in flat walls 22 and 42. As noted, fire pan 40 is constructed substantially identically to base 20 except that fire pan 40 includes an opening 56 therethrough that is adapted to provide connection access for a gas injector 90 discussed below. In addition, fire pan 40 has an annular shoulder portion 58 welded or otherwise formed at upper rim 46 with shoulder portion 58 extending continuously around the fire pan 40 and being operative to support lid 60 thereon when the lid is in the mounted state.

Lid 60 is likewise formed substantially identically to base 20 and fire pan 40. Thus, as is best shown in FIG. 3, lid 60 has a circular flat wall 62 and a side wall 64 formed as a conic section so that lid 60 is frustoconical in shape with an open lid interior 69. Side wall 64 extends from flat plate 62 to terminate in a rim 66. Lid 60 sports a handle 70 that is secured to flat wall 62 by means of threaded portion 74 extending through hole 76 into elongated threaded shaft 78. Lid 60 is sized and adapted to enclose the pan interior when placed thereon in a mounted state with a portion of the lid being supported by shoulder portion 58. In the mounted state the threaded shaft 78 engages the free end portion 36 of diffuser element 99 and is sized and adapted to secure the lid 60 onto the fire pan 40 when the lid is in the mounted state.

Figure 5:
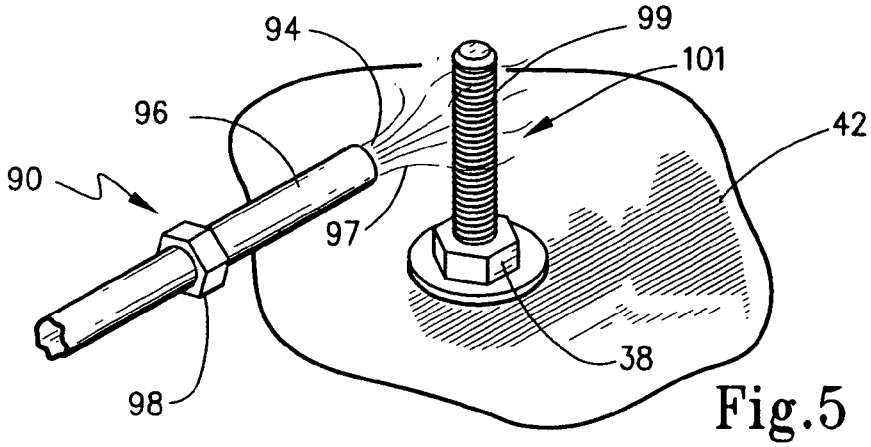
FIG. 5 is a perspective view of a diffuser element and gas outlet according to the present invention.

Gas injector 90 includes an extension 96 located within the open interior 52 which terminates in a gas outlet 94 operative to introduce vaporized fuel into the pan interior 52 when connected to a fuel source. The extension 96 is substantially a rigid tubular member. The gas injector 90 is disposed in and projects out of a hole 56 to terminate in a connector 98 that is operative to connect to a source of fuel when in the assembled state in a manner that is standard in the art. Referring to FIG. 5, a perspective of the injector 90 and diffuser 99, the extension 96 is sized and shaped to position the gas outlet 94 in close proximity to the diffuser element 99. In this manner the diffuser element 99 acts to outwardly disperse the vaporized fuel 97 into the surrounding particulate material 30. In this embodiment the diffuser element 99 includes a free end portion 36 to which the lid 40 may be secured, however, it should be appreciated that the diffuser element 99 may also be a separate element mounted onto the pan interior 52 and may take configurations other than exactly as depicted.

Diffuser 99 is provided to disperse fuel from injector 90. To this end, as is shown in FIGS. 3 and 5, the fuel from extension 96 of injector 90 is incident on diffuser 99. However, in construction, the vaporized fuel should be at least incident on a region 101 that is adjacent to diffuser element 99. That is, it is not necessary to aim the fuel directly at the diffuser element, but the direction should be sufficiently close so that the diffuser will act to disperse the fuel.

With reference to FIG. 3, it may be seen that campfire apparatus 10 also includes a quantity of low density, non-flammable particulate material 30 that is disposed in the fire pan 40 at a depth "d" that is sufficient to cover gas injector 90 and diffuser element 99 when in the assembled state so that injector 90 and diffuser element 99 are completely engulfed in the particulate material.

Preferably, the particulate material 30 possesses a sufficient amount of porosity to create and maintain vapor channels through and/or between the particles that permit the passage of gas through the particulate material 30. Particles of materials such as silicates, carbonates, coarse sands and certain ores possess sufficient gas porosity. More specifically, particles of clay, shale, slate, slag, zeolites, alumina hydrates, borates, perlite, vermiculite, beach sand, volcanic sand, sandblasting sand, and the like may be used. It should also be appreciated that certain types of silicates can be found both in an expanded or exfoliated form, as well as their crude or condensed form. This invention contemplates each of these various forms of silicates.

The preferred particulate material is vermiculite. Vermiculite is selected due to its property of permitting passage of the vaporized gas so that it migrates upwardly through the particulate material without igniting until it reaches surface 31 thereof. Moreover, vermiculite has been found to provide a matrix for the vaporized fuel that does not itself absorb heat or have a great thermal capacity. Thus, even when the fuel is ignited, the vermiculite material remains relatively cool to the touch. Moreover, the vermiculite does not produce embers that are discharged from campfire apparatus 10 when the fuel is ignited. Thus, there is a less potential for rogue fires resulting from embers being blown out of campfire apparatus 10. This is especially advantageous where the campfire apparatus 10 is used in a delicate, dry environment, such as a desert or arid camping area.

Figure 6:
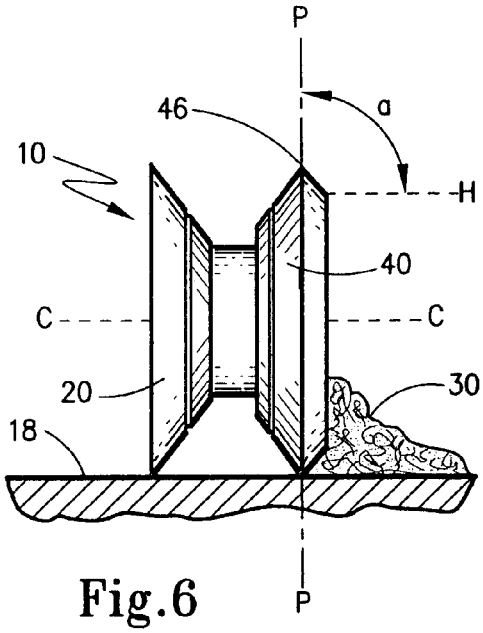
FIG. 6 is a side view in elevation of the campfire apparatus of FIGS. 1–4 shown in a tipped orientation.

In addition, as is illustrated in FIG. 6, another advantage of campfire apparatus 10 may be appreciated. Here, it may be seen that, by constructing base 20 and fire pan 40 substantially identically, with their central axes "C" aligned, the plane "P" of rim 46 of fire pan 40 is oriented at a perpendicular angle "a" with respect to the horizontal plane "H" when support surface 18 is horizontal and the campfire apparatus is tipped over. Should campfire apparatus 10 be purposelessly or inadvertently placed in a tipped condition, as is shown in FIG. 6, the vermiculite material 30 may spill out of fire pan 40 and remain in a fairly consolidated mass. It is also been found that, with the construction of campfire apparatus 10 as described with reference to FIGS. 1–3, the flame from gas injector 90 will become extinguished. Thus, any open fire in fire pan 40 will be extinguished with the vermiculite 30 forming a non-threatening mass, that is, a mass that is not likely to inadvertently spread unwanted fire.

Figure 7:
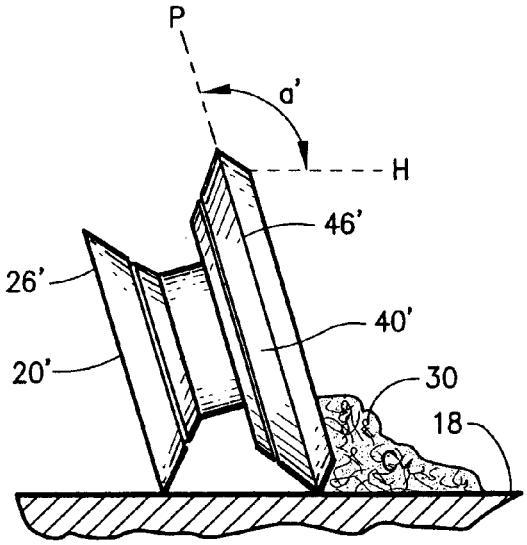
FIG. 7 is a side view in elevation, similar to FIG. 6, showing a tipped orientation of an alternative campfire apparatus wherein the base is smaller in dimension than the fire pan.

With reference to FIG. 7, it may be noted that base 20' in this embodiment has an edge 26' that is smaller in diameter than rim 46 of fire pan 40'. Accordingly, plane "P" is oriented at an angle "a'" with respect to the horizontal plane "H", that is, at an obtuse angle. Here again, the particulate mass 30 remains consolidated. Accordingly, it should be appreciated that, according to the present invention, a feature is having the rim of the fire pan 40 extend in a plane parallel to the support surface when in an upright position and, when in a tipped over position, the plane is oriented at no less than 90° to the support surface.

Figure 4:
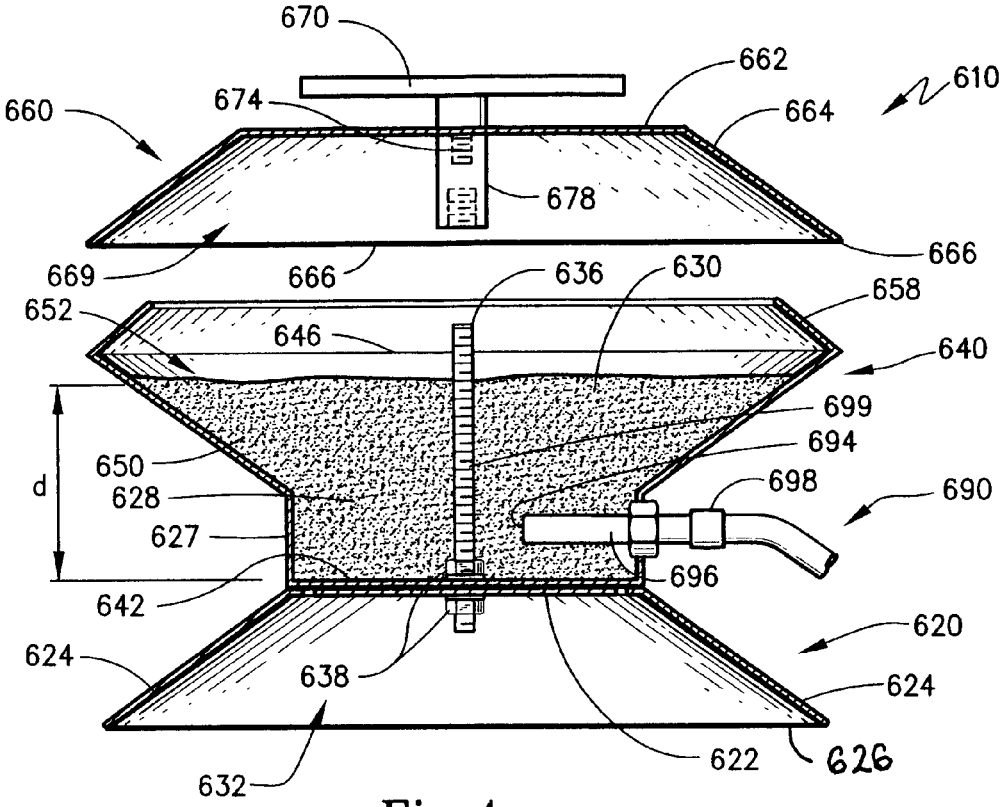
FIG. 4 is a sectional side view in elevation of a second embodiment of the campfire apparatus.

A second embodiment of the present invention is shown in FIG. 4. The campfire apparatus 610 includes a base 620, a fire pan 640 and may include a lid 660. The fire pan 640 includes a main body portion 650 formed as a conic section with a cylindrical lower chamber portion 627. The lower chamber portion 627 includes a circular flat wall 642 with a lower chamber interior 628. Similar to the first embodiment in FIGS. 2 and 3, the fire pan 640 includes a fire pan interior 652 and may include an annular shoulder portion 658 formed onto the upper rim 646 and being operative to support lid 610 when in the mounted state.

Still referring to FIG. 4, the base 620 is generally formed as an inverted frustum having a circular flat wall 622 and a side wall 624 that is formed of a conic section that extends from flat wall 622 to terminate in an edge 626 and to create an open interior 632. Similar to the first embodiment, the base 620 is attached to the lower chamber portion 627 of the fire pan 640 by the diffuser element 699 in the form of a threaded rod and nuts 638.

The fire pan 640 includes a gas injector 690, also similar to the gas injector 90 of the first embodiment. The gas injector 690 is adapted to the lower chamber portion 627 to position the gas outlet 694 of the extension 696 within the lower chamber interior 628. The gas injector 690 includes a connector 698 adapted to mate with a standard fuel source. The gas outlet 694 is positioned in close proximity to a diffuser element 699 which is operative to disperse the vaporized fuel into the particulate material 630. As discussed in the first embodiment, the particulate material 630 may be of a variety of types. The particulate material 630 is placed in the fire pan interior 652 to a depth "d" sufficient to cover the gas outlet 694 and diffuser element 699.

The fire pan 640 may also include a lid 660 which is formed substantially identical to base 620. Similar to lid 60 of the first embodiment, the lid 660 has a circular flat wall 662 and a side wall 664 formed as a conic section so that lid 660 is frustoconical in shape with an open lid interior 669. Side wall 664 extends from flat plate 662 to terminate in a rim 666. Lid 660 sports a handle 670 that is secured to flat wall 662 by means of threaded portion 674 extending through the flat wall 662 into elongated threaded shaft 678. Lid 660 is sized and adapted to enclose the pan interior when placed thereon in a mounted state with a portion of the lid being supported by shoulder portion 658. In the mounted state the threaded shaft 678 engages the free end portion 636 which is sized and adapted to secure the lid 660 onto the fire pan 640 when the lid is in the mounted state.

Figure 8:
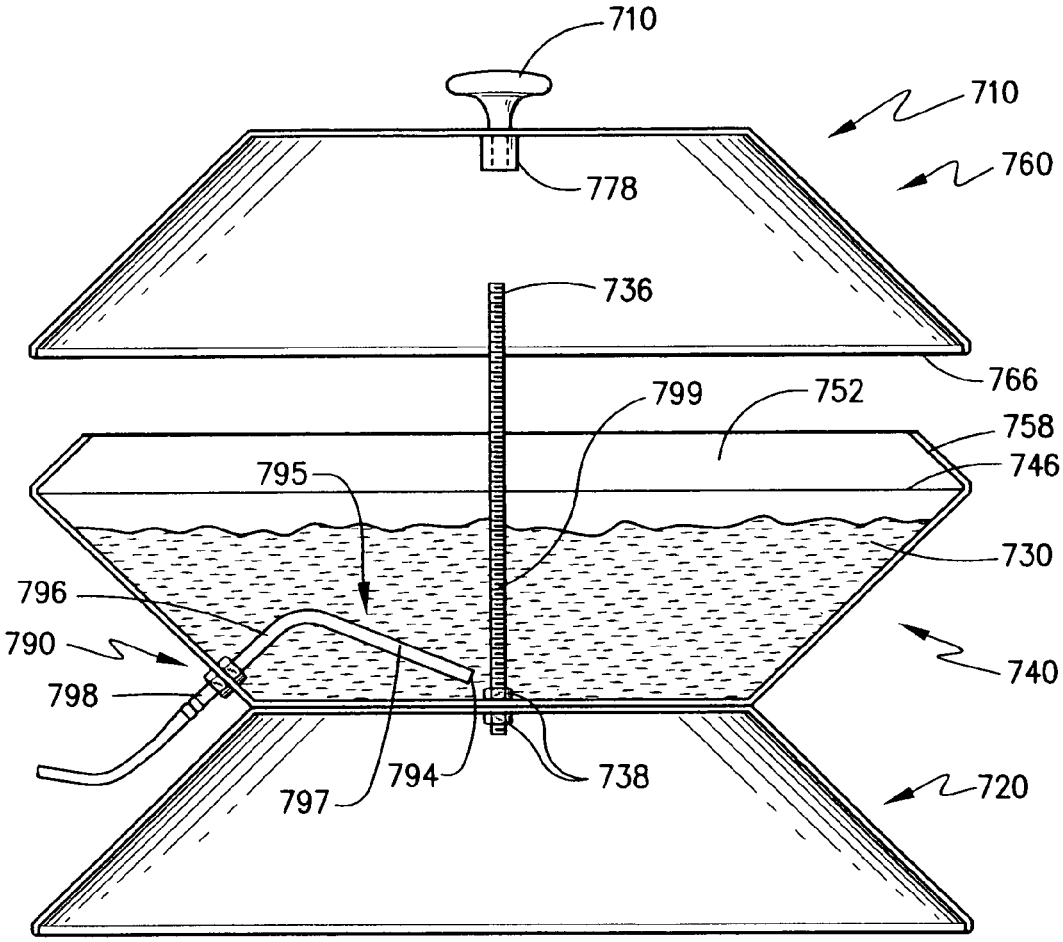
FIG. 8 is sectional side view in elevation of a third embodiment of the present invention.

A third alternative embodiment of the present invention is shown in FIG. 8. Campfire apparatus 710 includes a fire pan 740, a base 720 and a lid 760 all of which have generally the same geometric configuration as shells formed as truncated conical sections. The rim 746 of fire pan 740 includes an annular shoulder portion 758 which is sized to support the rim 766 of the lid 760 when in the mounted state. The lid 760 including the handle 770 and elongated threaded shaft 748 is similar to those of the first and second embodiments. The base 720 also possess the similar features of the base 20 and base 620 of the first and second embodiments (respectively).

As seen in FIG. 8 the fire pan 740 includes a gas injector 790 which introduces the vaporized fuel into the interior of the fire pan 752. The gas injector 790 includes a connector 798 adapted to connect to a standard fuel supply, an extension 795, and a gas outlet 794. The extension 795 and gas outlet 794 are sized and adapted to direct the vaporized fuel in close proximity to a diffuser element 799. Extension 795 is formed of two sections 796 and 797 that are at an obtuse angle to one another. These sections are oriented such that the fuel is directed downwardly toward the base of diffuser 799. As also seen in this FIG. 8, the diffuser element 799 is a threaded rod with a free end portion 736 which is operative to attach the base 720 to the fire pan 740 by means of nuts 738 and the free end portion 736 is sized to mate with the elongated threaded shaft 778 to attach the lid 760 to the fire pan 740 when in the mounted state.

Figure 9:
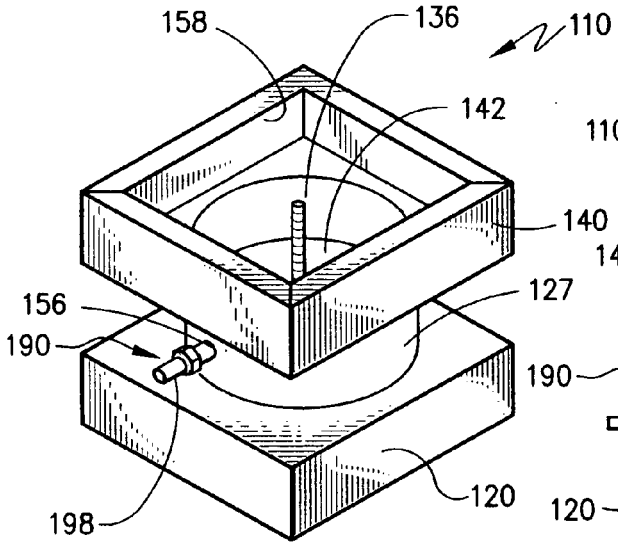
FIG. 9 is a perspective view of an alternative embodiment of a campfire apparatus according to the present invention.
Figure 10:
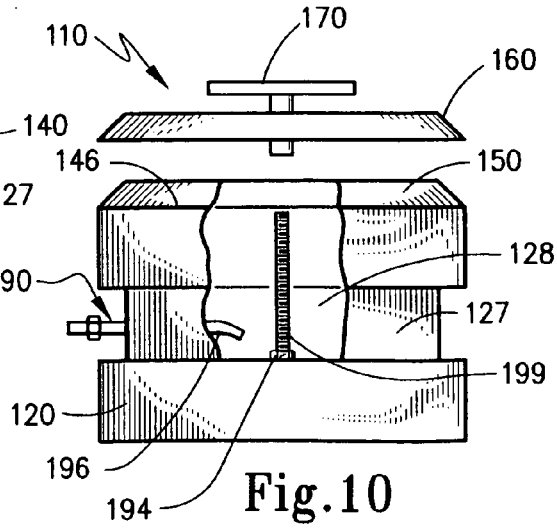
FIG. 10 is a side view in elevation, partially broken away, of the campfire apparatus of FIG. 9 including a lid structure therefor.

With reference now to FIGS. 9 and 10, another alternative embodiment of the present invention is shown. Here, campfire apparatus 110 is square-shaped so that the base 120 and the fire pan 140 are each structured as a rectangular (square) parallelepiped shell. Similar to the second embodiment in FIG. 4, the lower chamber portion 127 is formed as a cylindrical shell. Gas injector 190 is disposed in the lower chamber portion 127, near the square, flat wall 142. Gas injector 190 projects outwardly through opening 156 and is provided with a connector 198 to connect to a fuel source. As in the previous embodiments, extension 196 of the gas injector 190 extends into the lower chamber interior 128 and is disposed in closed proximity to the diffuser element 199.

A shoulder portion 158 projects upwardly and inwardly from rim 146 of fire pan 140 and is in the form of a truncated pyramid shell adapted to support the truncated pyramid-shape of lid 160. Lid 160 is again provided with a handle 170 to facilitate removal and placement on campfire apparatus 110. Similar to the previous embodiments, vermiculite (not shown) should be employed to a depth sufficient to cover the gas outlet 194 and diffuser element 199.

Figure 11:
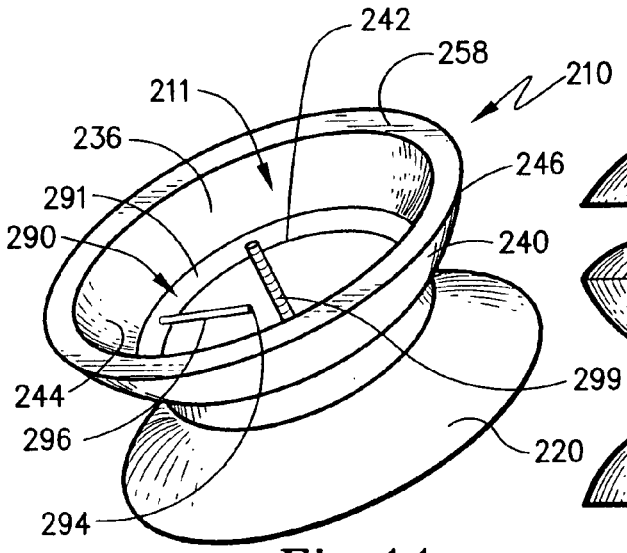
FIG. 11 is a perspective view of another alternative embodiment of a campfire apparatus according to the present invention.
Figure 12:
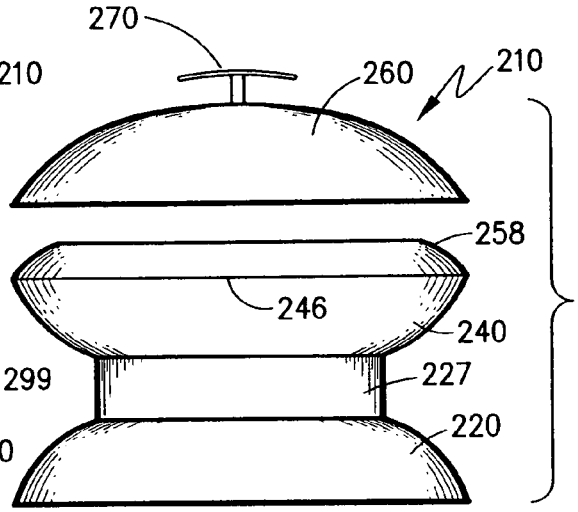
FIG. 12 is a side view in elevation of the campfire apparatus of FIG. 11 shown with its lid structure.
Figure 13:
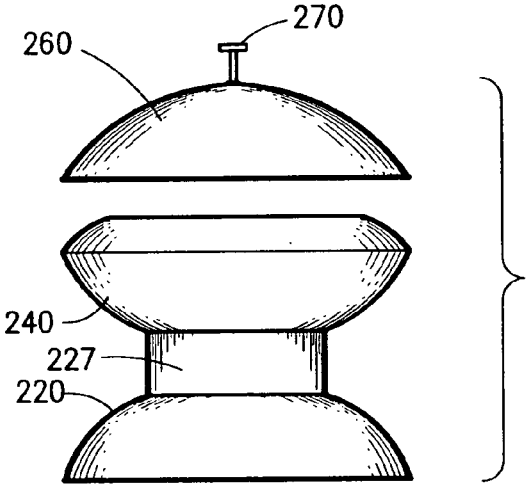
FIG. 13 is an end view in elevation of the campfire apparatus of FIG. 12.

Yet another exemplary embodiment of the present invention is shown in FIGS. 11 and 13. Here, camp stove or campfire apparatus 210 is formed to have an ovoid opening 211 formed by shoulder portion 258 extending from rim 246 of fire pan 240. Fire pan 240 and base 220 are formed as curvilinear shells with an oval or elliptical cross-section. Lower chamber portion 227 is in the form of an oval cross-section shell and is supported by base 220. Lower chamber portion 227 in turn supports fire pan 240, and a lid 260 is provided to rest on shoulder 258. Lid 260 is provided with handle 270 which may be configured as desired. As in the embodiments of FIGS. 4 and 9–10, a gas injector 290 is disposed on the lower chamber portion 227 and includes an extension 296 and gas outlet 294 which is placed in close proximity to the diffuser element 299. While the embodiment of campfire apparatus 210 is shown to have an oval opening, it should be appreciated that this opening could be circular without departing from the scope of the invention. Thus, base 220, fire pan 240 and lid 260 could be formed as portions of a spherical shell, if desired.

Figure 14:
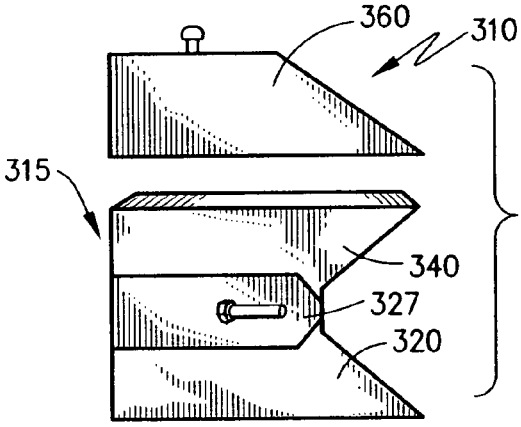
FIG. 14 is a side view in elevation of yet another alternative embodiment of a campfire apparatus according to the present invention.
Figure 16:
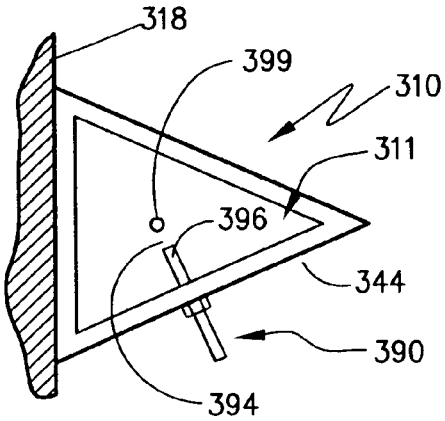
FIG. 16 is a top plan view of the campfire apparatus of FIGS. 14 and 15 shown without the lid structure therefor.
Figure 15:
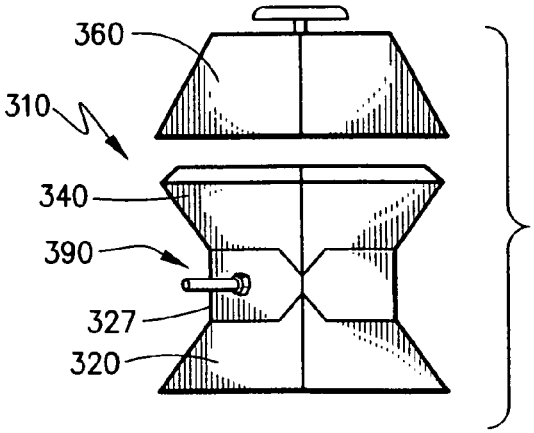
FIG. 15 is an end view in elevation of the campfire apparatus of FIG. 14.

Yet another exemplary embodiment of the present invention is shown in FIGS. 14–16. Here, campfire apparatus 310 has a triangular opening 311. Each of base 320, fire pan 340 and lid 360 are structured as truncated triangular pyramidal shells with fire pan 340 being supported by lower chamber portion 327 on base 320. As is shown in FIG. 16, the pyramid shape of base 320, fire pan 340 and lid 360 is skewed so that side 315 can be placed against a support wall 318, if desired. As in the embodiments of FIGS. 4 and 9–13 a gas injector is disposed on the lower chamber portion 327 and includes an extension 396 and gas outlet 394 which is placed in close proximity to the diffuser element 399.

Figure 18:
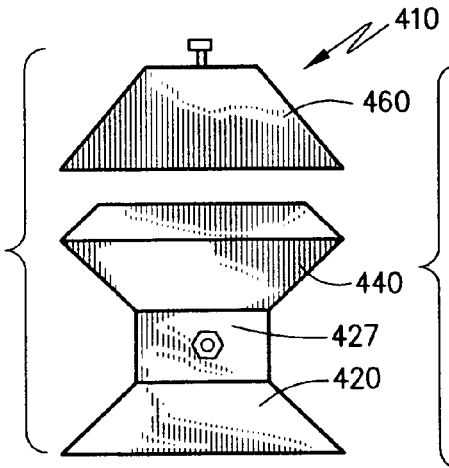
FIG. 18 is an end view in elevation of the campfire apparatus of FIG. 17.
Figure 17:
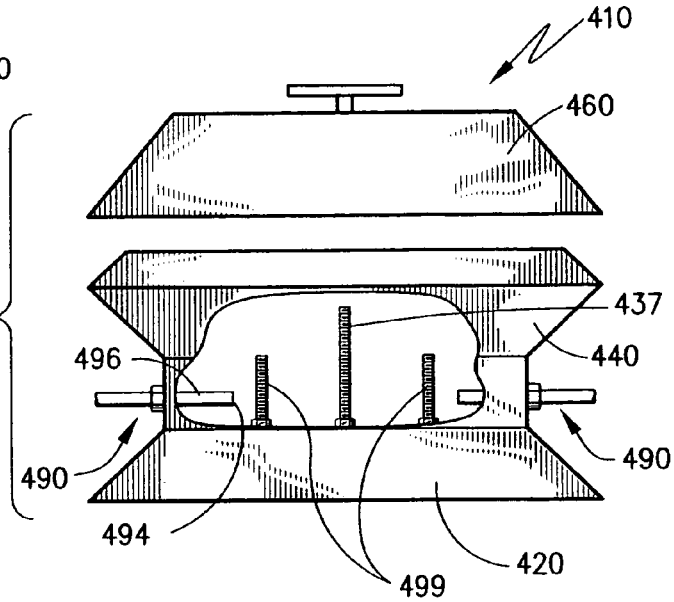
FIG. 17 is a side view in elevation of still a further alternative exemplary embodiment of a campfire apparatus according to the present invention.

With reference now to FIGS. 17–18, still another embodiment is shown wherein a campfire apparatus 410 includes a base 420, a fire pan 440 with a lower chamber portion 427 and a lid 460 for the fire pan 440. Here, the structure is similar to that described above as to the other embodiments. However, campfire apparatus 410 has a non-square rectangular opening with each of base 420, fire pan 440 and lid 460 being formed as truncated rectangular pyramid shells. As seen in FIG. 17 campfire apparatus 410 includes a plurality of gas injectors 490 and diffuser elements 499 which, similar to previous embodiments, are positioned such that the gas outlets 494 are in close proximity to their respective diffuser element 499 to disperse the vaporized fuel into the particulate material (not shown). A threaded rod 437 serves to attach the base 420 and fire pan 440 and to provide a connector for securing the lid 460 when in the mounted state.

Figure 19:
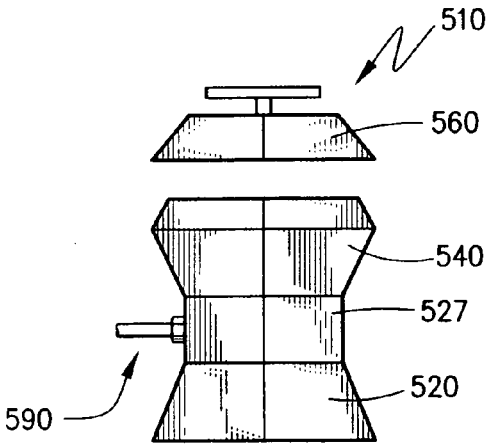
FIG. 19 is a side view in elevation showing a final exemplary embodiment of a campfire apparatus according to the present invention.
Figure 20:
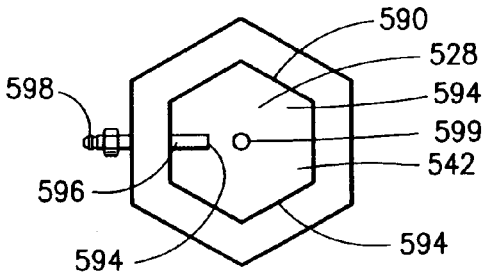
FIG. 20 is a top plan view of the campfire apparatus of FIG. 19 shown without the lid structure therefor.

Finally, with reference to FIGS. 19 and 20, yet another embodiment of campfire apparatus 510 is shown. Campfire apparatus 510 is hexagonal in configuration so that base 520, fire pan 540 and lid 560 are each constructed as truncated pyramidal shells having a hexagonal base. Lower chamber portion 527 is interposed between base 520 and fire pan 540 so that fire pan 540 is supported by lower chamber portion 527 that is in turn supported on base 520. As seen in these Figures and similar to the previous embodiments a gas injector 590 with connector 598, extension 596 and gas outlet 594 is provided for dispensing the vaporized fuel within the lower chamber interior 528. The gas outlet 594 is positioned within the lower chamber interior 528 within close proximity of the diffuser element 599.

From the foregoing, it should be understood that the shape of the base, the fire pan and the lid of campfire apparatus of the present invention can take a variety of geometric configurations, all believed to be within the scope of the ordinarily skilled artisan having now read the above description. For example, this configuration may be a portion of a spherical shell or shell of other curvilinear configuration, a truncated pyramidal shell, a rectangular (or square) parallelepiped shell, a polyhedron shell, a conical shell, a cylindrical shell or a pyramidal shell.

Further, from the above description, it should be appreciated that the present invention contemplates a method of providing a portable campfire on a support surface. This method includes any of the steps inherent in the above described apparatus. In particular, the method according to the present invention includes the step of providing a fire pan having an interior and wherein the interior and a gas injector disposed in the interior. This gas injector has at least one gas outlet operative to introduce vaporized fuel into the interior of the fire pan and in close proximity to a diffuser element. The method also includes the step of supporting the fire pan in spaced relation to the support surface so that the interior of the fire pan is upwardly opening. Next, the method includes the step of placing a quantity of low density, fire retardant particulate material in the fire pan at a depth sufficient to cover the gas outlet thereby to achieve a surface space completely above the gas outlet. The method then includes the step of introducing a fuel into the gas injector at a pressure sufficient so that vaporized fuel is injected into the particulate material in a manner whereby the vaporized fuel migrates upwardly therethrough without igniting until it reaches the surface of the particulate material. Finally, the method includes the step of igniting the vaporized fuel along the surface of the particulate material. In addition to these general steps, the method according to the present invention includes the selection of particles of materials such as silicates, carbonates, coarse sand and certain ores. Preferably, the particulate material according to the method is vermiculite.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiment of the present invention without departing from the inventive concepts contained herein.

I claim:

1. A campfire apparatus adapted to be placed in an assembled state on a support surface and connected to a source of fuel, comprising:

(A) a fire pan adapted to be supported in an upright orientation on a support surface, said fire pan having an upper rim and a pan interior;

(B) at least one diffuser element disposed in the pan interior of said fire pan and secured thereto when in an assembled state, said diffuser element having an exterior surface; and (C) a gas injector extending into the interior of said fire pan when in the assembled state and operative to introduce vaporized fuel into the pan interior when connected to the source of fuel, said gas injector terminating in a gas outlet located proximately to and directed toward said diffuser element such that vaporized fuel introduced into the pan interior is incident on a region of the exterior surface of said diffuser element, said diffuser element thereby operative to disperse the vaporized fuel about the fire pan interior exteriorly of said diffuser element when said gas introduces the vaporized fuel therein.

2. A campfire apparatus according to claim 1 including a quantity of low-density, non-flammable particulate material adapted to be disposed in said fire pan at a depth sufficient to cover the gas outlet when in the assembled state.

3. A campfire apparatus according to claim 2 wherein said particulate material is selected from a group consisting of clay, shale, slate, and slag particles, zeolites, alumina hydrates, borates, perlite, vermiculite and sand.

4. A campfire apparatus according to claim 2 wherein said particulate material is vermiculite.

5. A campfire apparatus according to claim 1 including a connector associated with said gas injector and adapted to connect to the source of fuel when in an assembled state.

6. A campfire apparatus according to claim 1 including a lid sized and adapted to enclose said pan interior when placed thereon in a mounted state.

7. A campfire apparatus according to claim 6 wherein said upper rim extends continuously around said fire pan and including an inwardly projecting shoulder portion disposed on said upper rim, said shoulder portion operative to support said lid when said lid is in the mounted state.

8. A campfire apparatus according to claim 1 wherein said fire pan is configured as a geometric shell selected from a group consisting of: a portion of a spherical shell, a truncated pyramidal shell, a rectangular parallelepided shell, a polyhedral shell, a conical shell, a cylindrical shell and a pyramidal shell.

9. A campfire apparatus according to claim 1 wherein said upper rim extends in a plane parallel to said support surface when in an upright position, and when in a tipped-over position, the plane of said upper rim is oriented at no less than ninety degrees to said support surface.

10. A campfire apparatus according to claim 1 wherein said fire pan includes a lower chamber portion defining a lower chamber interior and an upper pan portion, said gas outlet terminating in the lower chamber interior.

11. A campfire apparatus according to claim 1 wherein said diffuser element is centrally located in the pan interior.

12. A campfire apparatus according to claim 1 wherein said gas injector is configured as a substantially rigid, elongate tubular member.

13. A campfire apparatus according to claim 1 including a base adapted to rest on the support surface, said fire pan supported by said base when in the assembled state.

14. A campfire apparatus adapted to be placed in an assembled state on a support surface and connected to a source of fuel, comprising:

(A) a base adapted to rest on a support surface;

(B) a fire pan adapted to be supported by said base in an upright orientation on a support surface, said fire pan including a bottom wall and a surrounding sidewall so as to have an upper rim and an upwardly opening pan interior;

(C) a centrally located post defining a diffuser element disposed in the pan interior of said fire pan and secured thereto when in an assembled state, said post extending upwardly from said bottom wall to terminate in a free end portion; and (D) a gas injector extending into the interior of said fire pan when in the assembled state and operative to introduce vaporized fuel into the pan interior when connected to the source of fuel, said gas injector terminating in a gas outlet located proximately to and directed at said post such that vaporized fuel introduced into the pan interior is incident on said post, said post thereby operative to disperse the vaporized fuel about the fire pan interior when said gas introduces the vaporized fuel therein.

15. A campfire apparatus according to claim 14 wherein surrounding sidewall is upwardly divergent.

16. A campfire apparatus according to claim 15 wherein said fire pan includes a lower chamber portion formed by a downwardly depending skirt wall and said bottom wall and an upper pan portion formed by said surrounding sidewall, said gas injector located in the lower chamber portion.

17. A campfire apparatus according to claim 16 wherein said skirt wall is cylindrical in shape, said gas injector extending radially inwardly therefrom.

18. A campfire apparatus according to claim 14 including a lid sized and adapted to enclose said pan interior when placed thereon in a mounted state.

19. A campfire apparatus according to claim 18 wherein the free end portion of said post is threaded and wherein said lid includes a connector adapted to threadably mate with the free end portion whereby said lid may be selectively attached to said fire pan when in the mounted state.

20. A campfire apparatus according to claim 19 wherein said lid includes a rotatable handle operative to rotate said connector.

21. A campfire apparatus according to claim 14 wherein said fire pan has a central pan axis and said base has a central base axis, said base and said fire pan secured together such that the central base axis and said central pan axis are co-linear.

22. A campfire apparatus according to claim 21 wherein said post is operative to secure said base and said fire pan.

23. A campfire apparatus according to claim 14 including a quantity of low-density, non-flammable particulate material adapted to be disposed in said fire pan at a depth sufficient to cover the gas outlet when in the assembled state.

24. A campfire apparatus according to claim 23 wherein said particulate material is vermiculite.

25. A campfire apparatus adapted to be placed in an assembled state on a support surface, comprising:

(A) a base adapted to rest on the support surface when in the assembled state;

(B) a fire pan adapted to be supported by said base when in the assembled state and having a pan interior, said fire pan including a lower chamber portion defining a lower chamber interior and an upper pan portion having an inner surface, an upper rim and a pan portion interior;

(C) a lid sized and adapted to enclose the pan interior when in the assembled state, with a portion of said lid being supported by a portion of said upper rim;

(D) at least one diffuser element disposed in the pan interior and secured to said fire pan when in an assembled state;

(E) a gas injector extending into the pan interior when in the assembled state and operative to introduce vaporized fuel into the pan interior when connected to the source of fuel, said gas injector terminating in a gas outlet located proximately to said diffuser such that vaporized fuel introduced into the pan interior is incident on a region adjacent to said diffuser element, said diffuser element thereby operative to disperse the vaporized fuel about the pan interior when said gas introduces the vaporized fuel therein;

(G) a reservoir adapted to be placed in fluid communication with said gas injector and to provide a source of fuel; and (H) a quantity of low-density, non-flammable particulate material adapted to be disposed in said fire pan at a depth sufficient to cover the gas outlet when in the assembled state.

26. A campfire apparatus according to claim 25 wherein said gas injector is located entirely within said lower chamber.

27. A campfire apparatus according to claim 25 wherein said diffuser element is centrally located in the pan interior.

28. A method of providing an artificial campfire on a support surface, comprising the steps of:

(A) providing a fire pan having an interior and wherein said fire pan includes a gas diffuser disposed in the interior thereof, said gas diffuser having an exterior surface exposed to the interior of said fire pan;

(B) placing a quantity of non-flammable particulate material in said fire pan at a selected depth so as to have an upper surface;

(C) introducing a flow of gas into the interior of said fire pan at a location beneath the upper surface of said particulate material and proximate to said gas diffuser;

(D) directing the flow of gas in a direction toward the exterior surface of said gas diffuser at a sufficient velocity such that the flow is dispersed by said gas diffuser and diffused upwardly by said particulate material; and (E) igniting said fuel at the surface of said particulate material.

29. A method according to claim 28 wherein said particulate material is selected from a group consisting of clay, shale, slate, and slag particles, zeolites, alumina hydrates, borates, perlite, vermiculite and sand.

30. A method according to claim 28 wherein said particulate material is vermiculite.

31. A campfire apparatus adapted to be placed in an assembled state on a support surface and connected to a source of fuel, comprising:

(A) a fire pan adapted to be supported in an upright orientation on a support surface, said fire pan having an upper rim and a pan interior;

(B) a lid sized and adapted to enclose said pan interior when placed thereon in a mounted state with a portion of said lid being supported by the upper rim;

(C) at least one diffuser element disposed in the pan interior of said fire pan and secured thereto when in an assembled state, an upper portion of said diffuser element being configured to connect to said lid and thereby to selectively attach said lid to said fire pan when in the mounted state; and (D) a gas injector extending into the interior of said fire pan when in the assembled state and operative to introduce vaporized fuel into the pan interior when connected to the source of fuel, said gas injector terminating in a gas outlet located proximately to said diffuser element such that vaporized fuel introduced into the pan interior is incident on a region adjacent to said diffuser element, said diffuser element thereby operative to disperse the vaporized fuel about the fire pan interior when said gas introduces the vaporized fuel therein.

32. A campfire apparatus adapted to be placed in an assembled state on a support surface and connected to a source of fuel, comprising:

(A) a fire pan adapted to be supported in an upright orientation on a support surface, said fire pan including a lower chamber portion defining a lower chamber interior and an upper pan portion having an upper rim and a pan interior;

(B) at least one diffuser element disposed in the pan interior of said fire pan and secured thereto when in an assembled state; and (C) a gas injector extending into the interior of said fire pan when in the assembled state and operative to introduce vaporized fuel into the pan interior when connected to the source of fuel, said gas injector terminating in a gas outlet located in the lower chamber portion proximately to said diffuser element such that vaporized fuel introduced into the pan interior is incident on a region adjacent to said diffuser element, said diffuser element thereby operative to disperse the vaporized fuel about the fire pan interior when said gas introduces the vaporized fuel therein.

33. A campfire apparatus according to claim 32 wherein said gas injector is located entirely within said lower chamber.

* * * * *

UNITED STATES PATENT AND TRADEMARK OFFICE

CERTIFICATE OF CORRECTION

PATENT NO. : 6,926,517 B2
DATED : August 9, 2005
INVENTOR(S) : Daniel W. Van Vleet It is certified that error appears in the above-identified patent and that said Letters Patent is hereby corrected as shown below:

Column 3,
Line 35, "900" should read -- 90º --.

Signed and Sealed this

Eighth Day of November, 2005

JON W. DUDAS
*Director of the United States Patent and Trademark Office*